United States Patent [19]

Weigl

[11] 4,154,460

[45] May 15, 1979

[54] FASTENING DEVICE

[75] Inventor: Erwin Weigl, Brunn am Gebirge, Austria

[73] Assignee: TMC Corporation, Baar, Switzerland

[21] Appl. No.: 859,198

[22] Filed: Dec. 9, 1977

[30] Foreign Application Priority Data

Dec. 16, 1976 [AT] Austria ..... 9287/76

[51] Int. Cl.[2] ..... A63C 9/00

[52] U.S. Cl. ..... 280/611; 151/69

[58] Field of Search ..... 280/611, 614, 615; 24/16 R, 16 PB, 735 G; 9/310 A; 151/69

[56] References Cited

U.S. PATENT DOCUMENTS 3,917,300 11/1975 Salomon ..... 280/611

FOREIGN PATENT DOCUMENTS 512923 11/1971 Switzerland ..... 280/611

*Primary Examiner*—John A. Pekar
*Assistant Examiner*—Gene A. Church
*Attorney, Agent, or Firm*—Blanchard, Flynn, Thiel, Boutell & Tanis

[57] ABSTRACT

A device for facilitating the mounting of various parts onto a holding surface. The device is particularly readily adaptable for use in facilitating a mounting of various ski binding components, such as base plates and stepping plates, onto a ski. A holding member has a plurality of holes therein with a segment of material surrounding each of the holes. A screw is fixedly held in each hole. A notch is provided in the segment of material surrounding each hole to weaken the material at that particular location. A ski binding part, for example, is then mounted on top of the ski and the holding member laid on top of the ski binding part. The same screws fixed in the holding member are screwed through holes in the ski binding part into the ski to fasten the ski binding part to the ski. A tightening of the screws into tight engagement with the holding member will cause a breaking of the segment of material surrounding each of the holes at the notch to facilitate a quick removal of the holding member so that no portion thereof remains with the ski binding part fastened to the ski.

8 Claims, 6 Drawing Figures

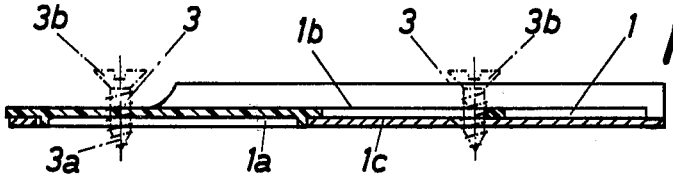
Fig. 1
Fig. 2
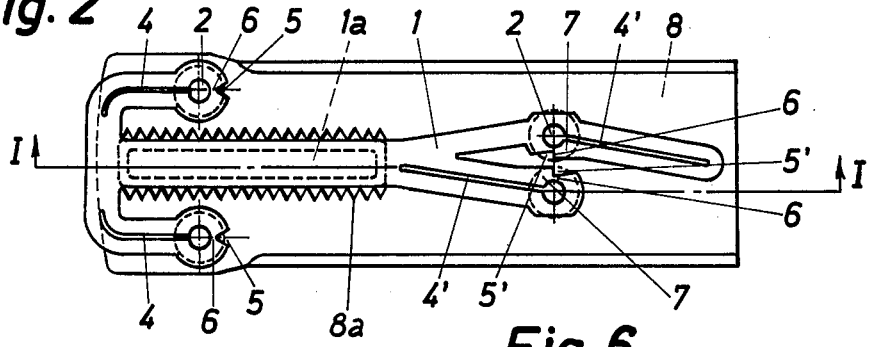
Fig. 6
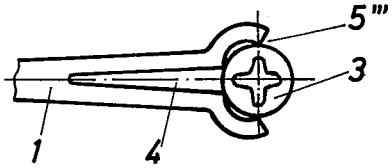
Fig. 3
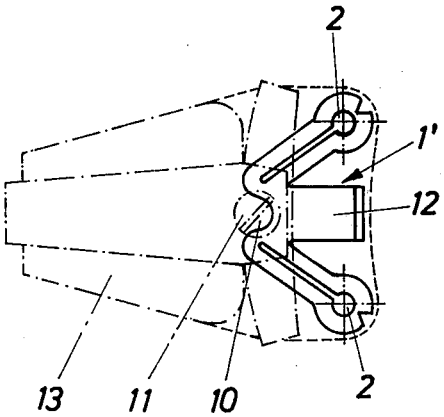
Fig. 4
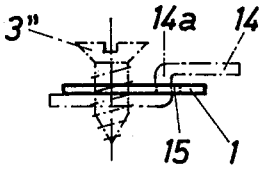
Fig. 5
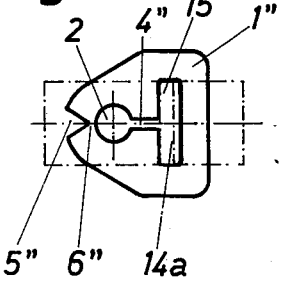

FASTENING DEVICE

FIELD OF THE INVENTION

The invention relates to a device for fastening of various parts on a holding surface, in particular for fastening of ski binding parts, for example a base or stepping plate or the like, on a ski, the parts each being provided with holes to receive screws which can be secured to the ski, wherein the device consists of one deformable holding member associated with each screw hole in the part, which holding member has an opening of a diameter which substantially equals the diameter of the associated screw, the individual screws being fixedly connected with respect to rotation and/or in which they are held with a press fit.

BACKGROUND OF THE INVENTION

Parts which are secured to a holding surface by means of screws are well-known in all fields of mounting techniques. It is also known to mount ski binding parts by means of their base or stepping plate structures onto the upper side of the ski and the holding surfaces of the ski binding parts have openings for insertion of the screws. It is furthermore known from Swiss Pat. No. 512,923 to use a mounting plate which consists of an elastic material arranged between the base or stepping plate and the upper side of the ski and has cylinderlike extensions received in the receiving openings of the base of stepping plate which must be mounted on the upper side of the ski. A disadvantage of this construction lies in a further part remaining between the base or stepping plate and ski, furthermore, the holding members of the elastic plate are not suited for storing the screws in the base or stepping plate which are not yet secured to the ski.

A base plate of the above-mentioned type is also known from Austrian Patent Application No. A 9973/73 which was published on Jan. 15, 1976, in which the screws are held with press fit in the holding members in the not as yet secured base plate. With this, mounting of the ski binding parts is supposed to be simplified. This known device has also the aforementioned disadvantage, namely that the holding members, after installation, remain with the ski binding parts together on the ski.

The purpose of the invention is to overcome the aforementioned disadvantage by providing a device of the abovementioned type such that after the installation additional structural parts are not also mounted to the mounting surface.

The set purpose is inventively attained by each holding member having at least one slot which is connected to the associated opening and at least one notch spaced from the opening so that the spacing provides a sufficient resistance for holding the screw ends, however, in the case of a complete screwing into the mounting surface tears open the existing material thickness at the notch and release the holding member for removal.

As a result, a simple device is provided, which is suited for holding the screws in the nonmounted condition of each part which must be secured to the mounting surface and which is automatically freed and can easily be removed through the inventive measure through or during the installation. The important advantage consists not only in the fact that after the installation no additional structural part remains together with the part to be fastened on the holding member but that screws of lesser length can be used, which circumstance in many cases is not only as such expense saving, but results due to the shorter length of the screws also in a reduction of their diameter. This can be advantageous in many cases; in the case of ski binding parts this measure is of great importance in view of the generally undesired weakening of the skis by the screws.

BRIEF DESCRIPTION OF THE DRAWING

Further advantages and details of the invention will be described more in detail with reference to the drawing which illustrates several exemplary embodiments.

In the drawing:

FIGS. 1 and 2 illustrate a first exemplary embodiment of the inventive device in associated views wherein FIG. 1 is a side elevational view and FIG. 2 is a top view;

FIG. 3 illustrates a second exemplary embodiment of the invention similar to FIG. 2;

FIGS. 4 and 5 illustrate a further exemplary embodiment in an arrangement similar to FIGS. 1 and 2; and FIG. 6 illustrates a fragment of a broken open holding member.

DETAILED DESCRIPTION

The first exemplary embodiment according to FIGS. 1 and 2 illustrates a generally flat, platelike holding member 1 having four openings 2 for receiving of screws 3 therein, which screws are illustrated in dash-dotted lines in FIG. 1. Each opening 2 opens into an elongated slot 4 in the holding member 1. The circular ring of material which encircles each of the openings 2 is interrupted at one point by a notch 5 and each of the notches 5 penetrate into the material a distance to leave a spacing 6 from the associated opening. It can furthermore be recognized that the notches 5 have a shape approximating a sector of a circle, however, with the one difference that the tip of this formation does not terminate at the centerpoint of the circular rings, but terminates on a radius, the dimension of which equals the sum of the opening radius and the dimension of the spacing 6.

The construction and arrangement of the notch 5 in the area of the respective opening 2 may differ for various reasons from the construction indicated in the preceding description. Thus for example, in the embodiment according to FIGS. 1 and 2 and referring to the two openings 2 which are laterally spaced a greater distance from one another, the construction of the notches 5 is designed corresponding with the aforedescribed embodiment, however, the notches 5' adjacent the two openings 2 which are arranged closely together have a form approximating a sector of a semicircle. It will be recognized from FIG. 2 that all of the material of the respective circular ring opening between the slot 4 and the notch 5 or 5' has approximately the size of a fourth of a circular arc. Depending on the material which is being used and its thickness, the necessary minimum amount of material may be more or less. For a better understanding, the circular ring segments which exist between the slots 4' and notches 5' have been identified with the reference numeral 7.

It will be recognized that the holding member 1 has reinforcement structure **1*a* in the area between the ends of the slots 4 or 4' which are remote from the openings 2. This measure can be of an advantage for both reasons of manufacture and also for possible further use of the holding member 1 for example for securement of a holding rail or a base plate 8. The holding member 1 is applied to the holding rail or base plate 8 by means of the reinforcement structure pressed form-closed into the teeth 8***a* of the holding rail or base plate 8. As is illustrated in dash-dotted lines in FIG. 1, the screws 3 are received in the openings 2 of the holding member 1 such that the tips 3*a* of the screws 3 project beyond the underside 1*c* of the holding member 1 and through the base plate 8 and the head 3*b* and a part of the thread of the screw 3 project above the upper side 1*b* of the holding member. Thus the screws 3 are positioned fixedly in the associated openings 2 so that following a dropping thereof or a shaking of the holding member 1, a dislodgment and resulting loss of the screws will not occur and the whole unit can be sent along with a ski binding part, for example, for mounting to the ski FIG. 2 shows the base plate 8 being secured to an upper surface of a not illustrated ski by means of screws 3, illustrated only in FIG. 1. For this purpose, it is sufficient to determine the necessary position of two screws, after which the holding member 1 with the base plate 8 is mounted at a determined position and the screws 3 thereafter tightened. Due to the fact that the screws 3 are screwed deeper into the openings 2, the enlarged heads thereof effect a spreading of the walls of the slots 4, 4' apart and at the same time the existing material in the spacing 6 is torn open to connect the slots 4, 4*a* with the openings and the holding member 1 is freed for removal from the ski. The holding rail or base plate 8 can then be secured to the ski by the screws 3.

The holding member 1' in the embodiment according to FIG. 3 is constructed similarly to the aforedescribed exemplary embodiment, with the difference that the holding member 1 has only two openings 2 for receiving of two screws (not illustrated) therein. A receiving portion or support shoulder 10 is provided in the central area through which the holding member 1' can be adjusted form-closed relative to a support screw 11. Furthermore, a mounting tab 12 can be provided so that the mounting 1' can be moved into a desired position. The holding member 1', which is illustrated in the top view of FIG. 3, is intended for example for the arrangement of fastening screws for a front jaw 13 illustrated in FIG. 3 only in dash-dotted lines.

The third exemplary embodiment according to FIGS. 4 and 5 illustrates a holding member 1'' having one opening 2 therein for receiving one single screw 3''. A slot 4'' is connected to the opening 2 and extends radially therefrom into a cross slot 15 so that the slot 4'' and cross slot 15 define a T-shape. A notch 5'' is provided in one edge of the holding member 1'' and is spaced from the opening 2 a distance 6. The screw 3'' illustrated in FIG. 4 also serves to secure an approximately S-shaped holding element 14 to the ski. It will be recognized from FIGS. 4 and 5 that the cross slot 15 in the holding member 1'' is provided for receiving a portion of the S-shaped holding element 14 and for effecting a clamping of the element 14 between the holding member 1'' and the ski. It will also be recognized that for the exact positioning of the S-shaped holding element 14, the recess 15 is adapted to receive form-closed the intermediate neck portion 14*a* of the holding element 14.

During a tightening of the screw 3'', the opening 2 of the holding member 1'' is torn open along the spacing 6'', after which the holding member 1'' can be removed and the S-shaped holding element 14 can be secured to its final position by tightening the screw 3''.

FIG. 6 illustrates a top view of a fragment of a holding member 1 in which the screw 3 has already torn open the existing material in the space 6 and has released the holding member for purposes of removal. The enlarged slot 4 and the notch 5''' which is torn open over its entirety will thereby be recognized. The detail according to FIG. 6 corresponds approximately with the embodiment according to FIG. 3, however, a similar situation can be created in each illustrated holding member 1' or 1'' or also in a holding member which is not illustrated, however, is constructed in the sense of the invention. Only the position of the torn-open material will change corresponding with the provided breaking point.

In this sense, the invention is not to be limited to the listed exemplary embodiments, namely neither with respect to the construction nor with respect to the purpose of usage. Holding members with any desired branching and also with differently designed breaking points can be used; it is also conceivable to provide several breaking points. Also the purpose of use can be manifold.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for facilitating the securement of a ski binding part to a ski, said ski binding part having at least one hole extending therethrough, said device comprising:

a deformable screw holding member;

means defining a hole extending through said deformable screw holding member and normally alignable with said hole in said ski binding part and a screw received in said hole, said screw having an enlarged head, the diameter of said hole being less than said enlarged head and sufficient to frictionally hold said screw therein while simultaneously permitting a rotation of said screw relative to said holding member through the application of a turning force thereto by a tool;

an elongated slot in said deformable holding member extending therethrough and opening into said hole at one end and being closed at the other end thereof; and a notch in the material of said deformable holding member encircling said hole, said notch extending inwardly toward said hole but the innermost part thereof being spaced radially outwardly from said hole a predetermined distance, said radially outward spacing providing sufficient strength for holding said screw in said hole but insufficient strength when said enlarged head engages the perimeter of said hole during an axial movement thereof caused by a screwing of said screw into said ski through said hole in said ski binding part and deforms said holding member by enlarging said hole, the material of said holding member between said innermost part of said notch and said hole breaking to thereby release said holding member from a frictional engagement with said screw and facilitate a removal of said holding member from cooperative engagement with said screw.

2. The device according to claim 1, wherein said hole in said holding member has a constant diameter through said holding member.

3. The device according to claim 1, wherein said holding member has a receiving portion thereon for facilitating an adjustment form-closed to a binding part secured to said ski.

4. The device according to claim 1, wherein said holding member has a handle thereon for facilitating a removal thereof from said ski binding part.

5. The improved device according to claim 1, wherein in the condition of the holding member, when it is not as yet screwed onto the ski, the tips of the screws project over the underside of the holding member and the head and a part of the thread project over the upper side of the holding member.

6. The device according to claim 1, including means for cooperatively coupling said holding member to said ski binding part with said holes in said holding member and said ski binding part being axially aligned, said screw being frictionally held in said hole in said holding member.

7. The device according to claim 6, wherein said cooperatively coupling means on said holding member includes a reinforcement portion which is suited for insertion into a holding rail on said ski binding part to effect a frictional holding of said holding member to said ski binding part.

8. The device according to claim 1, wherein said holding member has means defining a plurality of holes therethrough each alignable with one of a plurality of corresponding holes in said ski binding part, said holding member having a plurality of said slots and said notches, one each per hole in said holding member, said holding member, following a breaking of the material between the innermost part of each notch and said hole, being removable as a unit from cooperative engagement with said screws.

* * * * *

UNITED STATES PATENT AND TRADEMARK OFFICE

CERTIFICATE OF CORRECTION

PATENT NO. : 4 154 460

DATED : May 15, 1979

INVENTOR(S) : Erwin Weigl

It is certified that error appears in the above-identified patent and that said Letters Patent are hereby corrected as shown below:

Please cancel Claim 5.

On the title page, under the Abstract, "8 Claims" should read -- 7 Claims --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*